US010681950B2

(12) United States Patent
Wiza

(10) Patent No.: US 10,681,950 B2
(45) Date of Patent: Jun. 16, 2020

(54) HAT WITH ILLUMINATION SYSTEM

(71) Applicant: Michael Wiza, Spring Grove, IL (US)

(72) Inventor: Michael Wiza, Spring Grove, IL (US)

( * ) Notice: Subject to any disclaimer, the term of this patent is extended or adjusted under 35 U.S.C. 154(b) by 0 days.

(21) Appl. No.: 15/970,869

(22) Filed: May 3, 2018

(65) Prior Publication Data

US 2018/0317584 A1 Nov. 8, 2018

Related U.S. Application Data

(60) Provisional application No. 62/500,727, filed on May 3, 2017.

(51) Int. Cl.

| | |
|---|---|
| ***A42B 1/00*** | (2006.01) |
| ***A42B 1/20*** | (2006.01) |
| ***F21V 33/00*** | (2006.01) |
| ***F21V 3/02*** | (2006.01) |
| ***F21V 23/02*** | (2006.01) |
| ***F21V 23/04*** | (2006.01) |
| *F21Y 115/10* | (2016.01) |
| *F21W 121/06* | (2006.01) |

(52) U.S. Cl.

CPC ..... *A42B 1/004* (2013.01); *A42B 1/205* (2013.01); *F21V 3/02* (2013.01); *F21V 23/02* (2013.01); *F21V 23/04* (2013.01); *F21V 33/0008* (2013.01); *F21W 2121/06* (2013.01); *F21Y 2115/10* (2016.08)

(58) Field of Classification Search

CPC . A41D 1/002; A41D 3/00; A41D 1/06; A41D 1/08; G02B 6/006; G02B 6/0051

See application file for complete search history.

(56) References Cited

U.S. PATENT DOCUMENTS

| | | | | |
|---|---|---|---|---|
| 5,363,291 | A | 11/1994 | Steiner | |
| 8,550,651 | B2 * | 10/2013 | Waters | A42B 1/244 2/209.13 |
| 9,526,287 | B2 * | 12/2016 | Waters | A42B 1/244 |
| 2016/0135515 | A1 * | 5/2016 | Campbell | A42B 1/242 362/607 |
| 2016/0324235 | A1 * | 11/2016 | Campbell | A42B 1/242 |

* cited by examiner

*Primary Examiner* — Joseph L Williams

(74) *Attorney, Agent, or Firm* — Integrity Patent Group, PLC; Charles E. Runyan

(57) ABSTRACT

A hat with illumination system including a hat having a logo with an integrated light assembly including a lens, a battery, at least one light, and a control-unit. The hat includes the logo with the integrated light assembly on a front outer surface of the hat. The light assembly is made up of the lens, the battery, the at least one light and the control unit in functional combination providing an illumination system to functionally display the logo in low light conditions. The device may be used to show fan support at night games or during low light conditions.

15 Claims, 7 Drawing Sheets

HAT WITH ILLUMINATION SYSTEM

CROSS REFERENCE TO RELATED APPLICATION

The present application is related to and claims priority to U.S. Provisional Patent Application No. 62/500,727 filed May 3, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of apparel and more specifically relates to hats.

2. Description of Related Art

Many people wear hats. A hat is a head covering. Hats can be worn for a variety of purposes, such as military to denote branch of service and rank, to work helmets that offer protection from falling debris at a work site. There are also hats associated with different professions, and religions. Sports enthusiasts are always looking for new ways to show pride for their favorite team. Many fans enjoy wearing team gear, such as hats and jerseys to display their support. In dark environments, such as at a night game, it can be difficult to see the logo on an individual's hat. An efficient solution is desired.

U.S. Pat. No. 5,363,291 to Gregory A. Steiner relates to a portable light assembly. The described portable light assembly includes a two-piece portable light assembly adapted for illuminating and attention focusing with respect to a logo or other design, consisting of a base formed by a housing for accommodating a power source and appropriate leads from the power source extending therefrom. The housing includes a pair of stakes which are interconnected with the power source leads, the stakes extending laterally outwardly from the housing in parallel relation. The portable light assembly is completed by a light carrying ledge which is provided with a rear wall having a pair of stake apertures formed in the rear wall, and a light bulb positioned in a light bulb aperture formed in the ledge wall extending outwardly from the rear wall. The light bulb has a pair of leads which extend into the stake apertures, such that when the stakes from the housing are inserted into the stake apertures, the circuitry between the power source and the light bulb is established. The portable light assembly is adapted to have a sheet of perforatable material interposed between the housing and the ledge, the material having a logo or other similar design intended to be illuminated. When in position, the light bulb carried in the ledge of the light assembly will illuminate the logo.

BRIEF SUMMARY OF THE INVENTION

In view of the foregoing disadvantages inherent in the known apparel art, the present disclosure provides a novel hat with illumination system. The general purpose of the present disclosure, which will be described subsequently in greater detail, is to provide an illumination system to functionally display said logo in low light conditions and provide a light source.

A hat with illumination system is disclosed herein. The hat with illumination system includes a hat having a logo with an integrated light assembly which includes a lens, a battery, at least one light, and a control-unit. The hat includes the logo with the integrated light assembly. The logo configured on a front outer surface of the hat. The battery is in communication with and provides power to the at least one light. The control unit is configured to be manipulated by a user and control power being provided to the at least one light. The light assembly comprises the lens, the battery, the at least one light and the control unit in functional combination providing an illumination system to functionally display the logo in low light conditions. Certain embodiments may have the light housing flush with the outer surface of the hat and the controls accessible on the inside of the hat. In this embodiment the housing is inset and is received by the hat.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a hat with illumination system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to apparel and more particularly to a hat with illumination system as used to improve the use of hats.

Generally, the present invention provides a ball cap with an illuminated logo made to represent a wide variety of professional and collegiate sports teams. It allows sports fan to support their favorite team by wearing an illuminated cap in dimly lit conditions. It offers an effective method of displaying support at evening sporting events, indoor sporting events, in bars, and anywhere else desired. It includes a cap with a sports logo with an integrated LED light that can be easily activated when the environment gets dark. The present invention provides a unique and exciting souvenir option to be sold at professional and collegiate sporting events. Sports Lite Cap offers sports fans a unique method for displaying their team pride.

Figure 6:
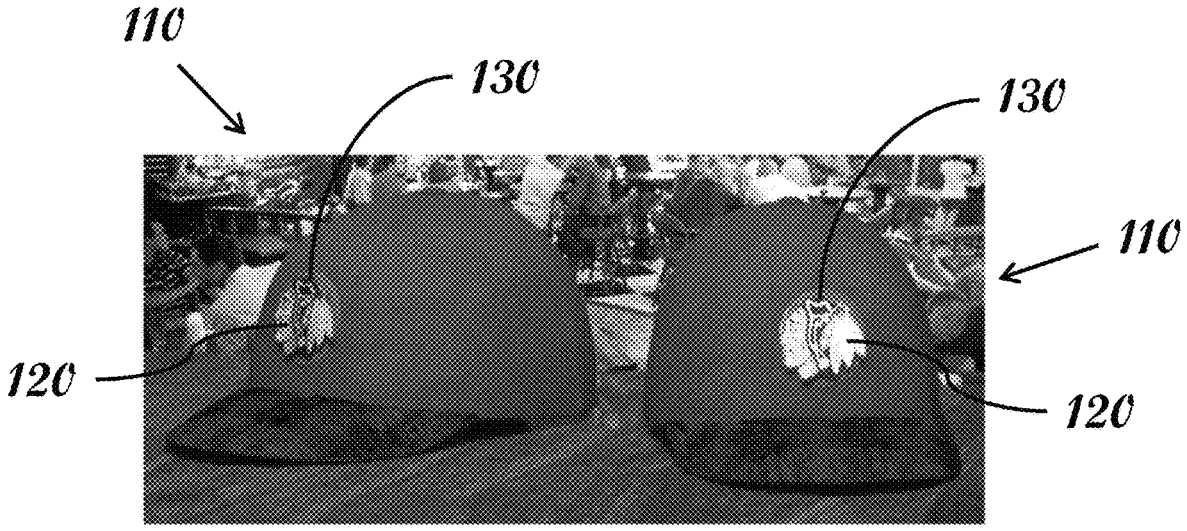
FIG. 6 is a front view of two hats in accordance with the present disclosure in which the entire logo and lens of the light assembly are illuminated in the hat shown on the right, and not illuminated in the hat shown on the left.
Figure 7:
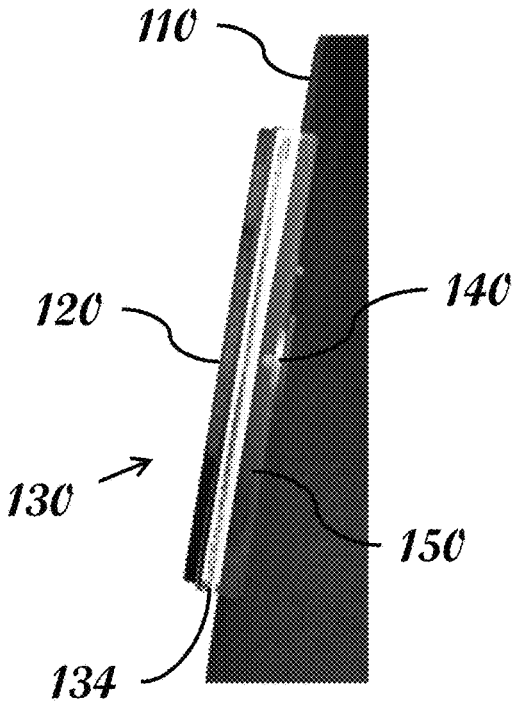
FIG. 7 is a side see-through view of the front of a hat in accordance with the present disclosure in which the logo and lens of the light assembly are not illuminated.
Figure 8:
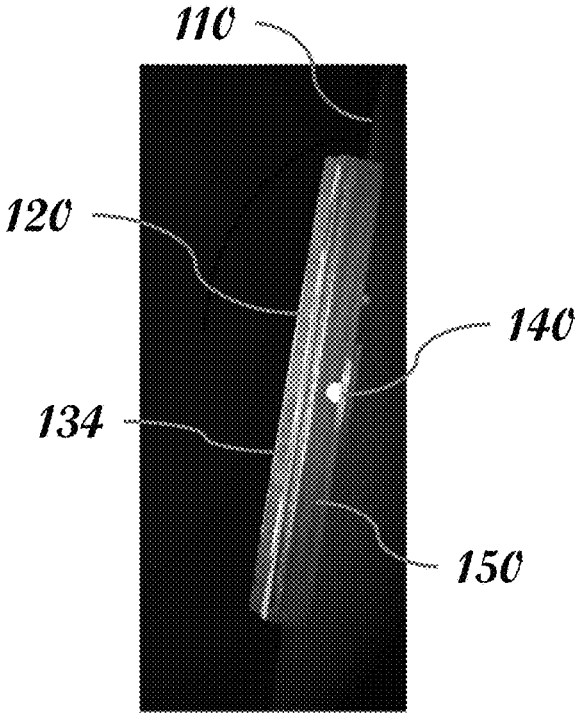
FIG. 8 is a side see-through view of the front of the hat if FIG. 7 in which the logo and lens of the light assembly are illuminated by the light.

The invention is comprised of a sports cap with a light assembly having an approximately 2¼" diameter plastic lens on the front middle of the hat defining a front surface of the light assembly. The lens may have varying thicknesses. In a preferred embodiment, the thickness is approximately 1/16". A marking process applies the sports team logo onto the lens in sharp colors and the lens should be scratch resistant. The light assembly further includes a replaceable battery and an LED light. A light diffuser may also be required. The light assembly includes an on/off switch to turn on the light when required. A housing 150 is required to hold the front lens in place, along with the battery, LED light (or other bulb source). A diffuser may further be included. A voltage supply may be 3 volts. The color of each hat may be that of the team colors. The hat may be available in a wide variety of professional and collegiate sports teams. In one embodiment the lens with team logo is 'more' flush with a front of the cap. Colors of the logo on the lens will be sharp, distinct and will emit a glow in result of the back lighting of the entire lens that will create visual interest and admiration as illustrated in FIG. 6. Logo artwork on the lens includes but is not limited to professional and collegiate sports teams along with corporate logos. The lens marking may be applied via digital screening, pad printing, heat transfer, silk screening or foil stamping. Upon reading this specification, it should be appreciated that, under appropriate circumstances, considering such issues as user preferences, design preference, structural requirements, marketing preferences, cost, available materials, technological advances, etc., other light arrangements may be sufficient. Certain embodiments may have the light assembly substantially flush with the outer surface of the hat and the controls accessible on the inside of the hat. In this embodiment the housing 150 is inset and is received by the hat (or may be integral with the hat) as illustrated for example in FIGS. 7 and 8.

Figure 1:
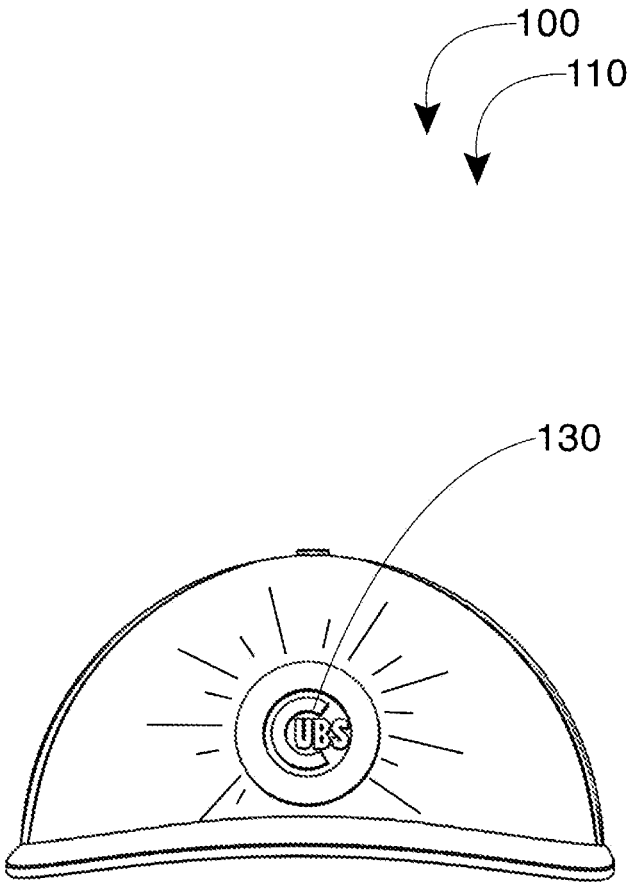
FIG. 1 is a perspective view of the hat with illumination system during an 'in-use' condition, according to an embodiment of the disclosure.
Figure 2:
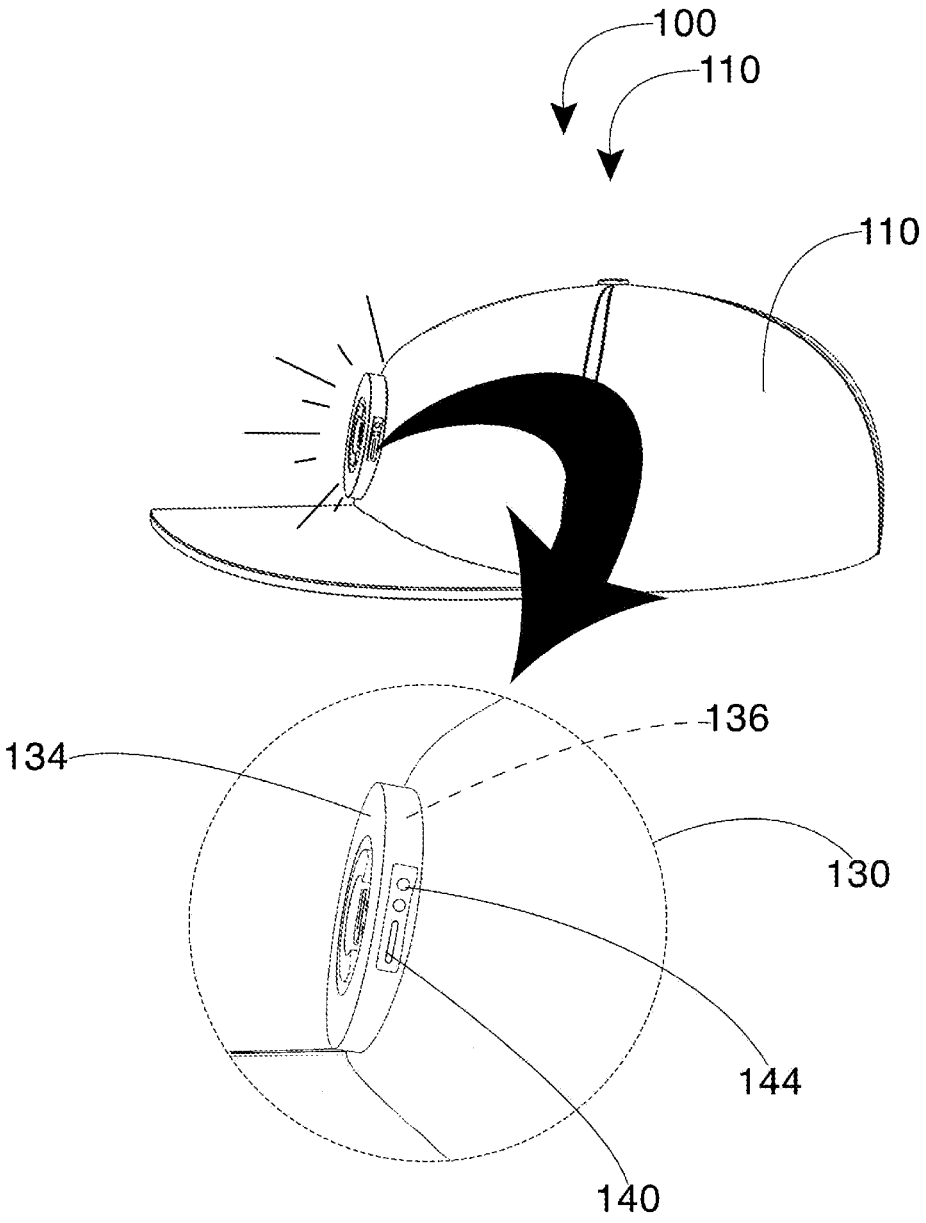
FIG. 2 is a perspective view of the hat with illumination system of FIG. 1, according to an embodiment of the present disclosure.
Figure 3:
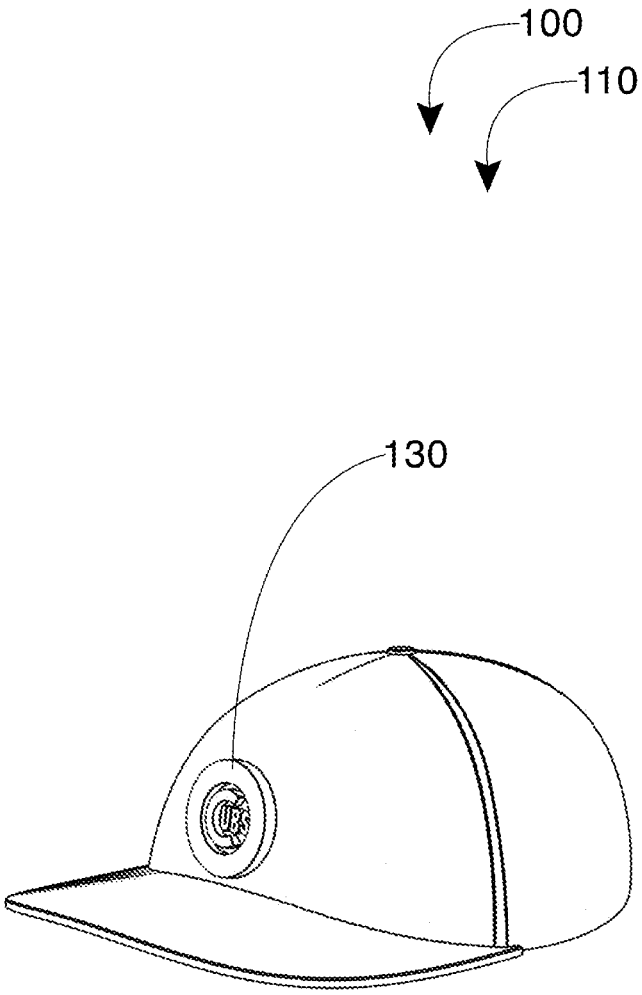
FIG. 3 is a perspective view of the hat with illumination system of FIG. 1, according to an embodiment of the present disclosure.
Figure 4:
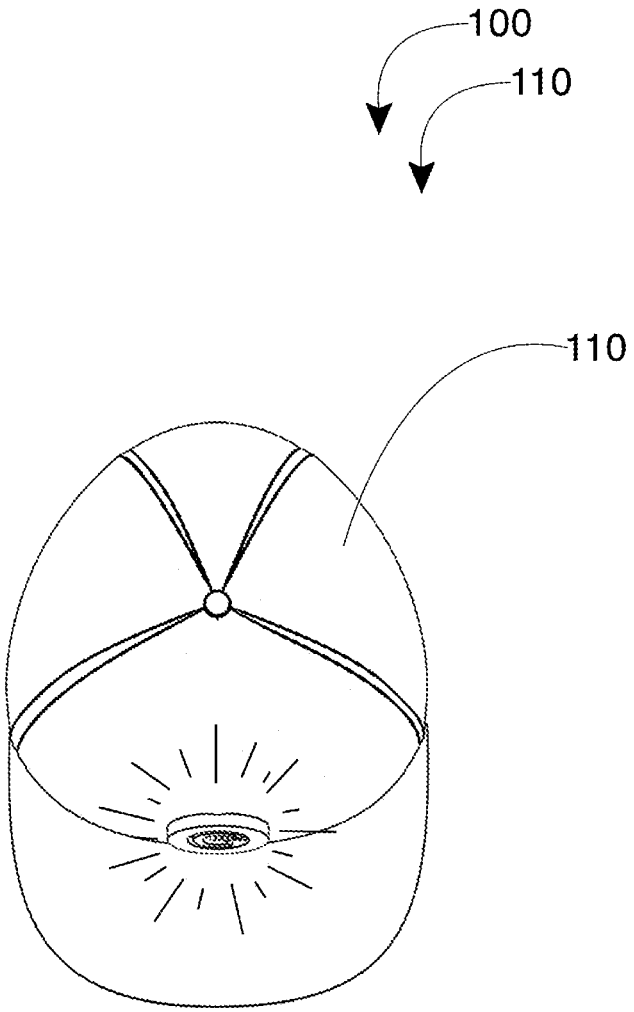
FIG. 4 is a perspective view of the hat with illumination system of FIG. 1, according to an embodiment of the present disclosure.
Figure 5:
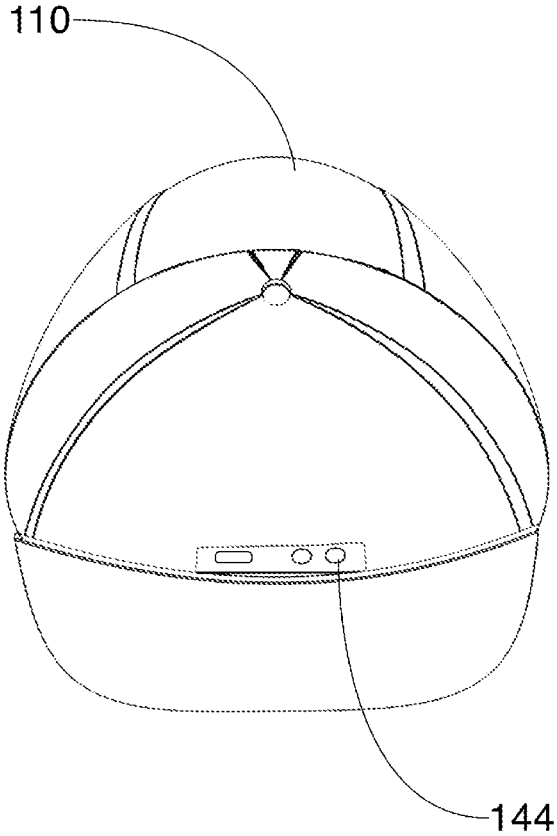
FIG. 5 is another perspective view of the hat with illumination system of FIG. 1, according to an embodiment of the present disclosure.

Referring now more specifically to the drawings by numerals of reference, there is shown in FIGS. 1-5, various views of a hat with illumination system 100. FIG. 1 shows a perspective view of a hat with illumination system 100, according to an embodiment of the present disclosure. As illustrated, the hat with illumination system 100 may include a hat 110 having a logo 120 with an integrated light assembly 130 which includes a lens 134, a battery 136, at least one light 140, and a control-unit 144. The hat 110 includes the logo 120 with the integrated light assembly 130. The logo 120 configured on a front outer surface of the hat 110. The battery 136 is in communication with and provides power to the at least one light 140. The control unit 144 is configured to be manipulated by a user and control power being provided to the at least one light 140. The light assembly 130 comprises the lens 134, the battery 136, the at least one light 140 and the control unit 144 in functional combination providing an illumination system to functionally display the logo 120 in low light conditions.

FIGS. 2-5 show various perspective views of the hat with illumination system 100 of FIG. 1, according to an embodiment of the present disclosure. As above, the hat with illumination system 100 may include the hat 110 having the logo 120 with the integrated light assembly 130 including the lens 134, the battery 136, at least one light 140, and the control-unit 144. In a preferred embodiment the hat 110 is a baseball cap. The logo 120 and the light assembly 130 are integral to the hat 110. The lens 134 may include a plurality of colors. The lens 134 is configured to be scratch resistant and transparent allowing light to emit from the at least one light 140. The lens 134 is substantially flush with the front outer surface of the hat 110. The lens 134 comprises a circular profile having a diameter of approximately 2.25 to 3 inches. The logo 120 is applied to the lens 134 via digital screening, pad printing, heat transfer, silk screening or foil stamping or other suitable means. The logo 120 may be a sports-team-logo or other logo 120 that a user wishes to display. Such wear may make the user-wearer easy to identify in a crowd during low-light conditions.

The hat 110 and the light assembly 130 are configured to functionally display the logo 120 and fan support during low light conditions. The at least one light 140 may be an LED-light or other bulb light. The hat with illumination system 100 may further include a light diffuser. The control-unit 144 comprises an on/off switch allowing the user to turn the light assembly 130 on or off as desired. The battery 136 is preferably removeable and replaceable. Other batteries 136 and powering means may be used.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A hat with illumination system comprising:

a hat having;

an integrated light assembly including;

a lens defining a front surface of the integrated light assembly;

a color logo applied to the lens;

a battery;

at least one light;

a control-unit; and a housing configured to hold the lens, the battery, and the light;

wherein said hat includes said integrated light assembly, said housing inset in and received by a front surface of said hat;

wherein said color logo substantially covers a surface of the lens;

wherein said battery is in communication with and provides power to said at least one light;

wherein said control unit is configured to be manipulated by a user and control power being provided to said at least one light; and wherein said integrated light assembly comprises said lens with said color logo, said battery, said at least one light, said housing, and said control unit in functional combination providing an illumination system to functionally backlight the entire lens and color logo causing the entire lens and color logo to emit a glow and display said color logo in low light conditions.

2. The hat with illumination system of claim 1, wherein said hat is a baseball cap.

3. The hat with illumination system of claim 1, wherein said lens is substantially flush with said front outer surface of said hat.

4. The hat with illumination system of claim 1, wherein said color logo is applied to said lens by digital screening, pad printing, heat transfer, silk screening, or foil stamping.

5. The hat with illumination system of claim 4, wherein said color logo is a sports-team-logo.

6. The hat with illumination system of claim 1, wherein said at least one light is an LED-light.

7. The hat with illumination system of claim 1, further comprising a light diffuser.

8. The hat with illumination system of claim 1, wherein said control-unit comprises an on/off switch.

9. The hat with illumination system of claim 1, wherein said battery is removeable and replaceable.

10. The hat with illumination system of claim 1, wherein said lens is configured to emit light from said at least one light.

11. The hat with illumination system of claim 1, wherein said light assembly is integral to said hat.

12. The hat with illumination system of claim 11, wherein said hat and said light assembly are configured to functionally display said logo during said low light conditions.

13. The hat with illumination system of claim 10, wherein said lens comprises a circular profile.

14. The hat with illumination system of claim 13, wherein said lens comprises a diameter of approximately 2.25 to 3 inches.

15. A hat with illumination system, the hat with illumination system comprising:

a hat having;

an integrated light assembly including;

a lens defining a front surface of the integrated light assembly;

a color logo applied to the lens;

a battery;

at least one light;

a control-unit; and a housing configured to hold the front lens, the battery, and the light;

wherein said hat includes said integrated light assembly;

wherein said housing is inset in and received by a front surface of said hat;

wherein said hat is a baseball cap;

wherein said battery is in communication with and provides power to said at least one light;

wherein said battery is removeable and replaceable;

wherein said at least one light is an LED-light;

wherein said control unit is configured to be manipulated by a user and control power being provided to said at least one light;

wherein said control-unit comprises an on/off switch;

wherein said integrated light assembly comprises said lens with said color logo, said battery, said at least one light, said housing, and said control unit in functional combination providing an illumination system to functionally backlight the entire lens and color logo causing the entire lens and color logo to emit a glow and display said color logo in low light conditions;

wherein said logo comprises a plurality of colors;

wherein said lens comprises a circular profile;

wherein said lens comprises a diameter of approximately 2.25 to 3 inches;

wherein said lens is configured to emit light from said at least one light;

wherein said logo is applied to said lens;

wherein said logo is a sports-team-logo; and wherein said hat and said light assembly are configured to functionally display said logo during said low light conditions.

* * * * *